US005714211A

United States Patent [19]

Zinbarg et al.

[11] Patent Number: 5,714,211

[45] Date of Patent: *Feb. 3, 1998

[54] CHRISTMAN TREE ORNAMENT ASSEMBLIES

[75] Inventors: Benson E. Zinbarg; Nancy E. Mimoun, both of Stamford; Michael C. Wotton, Plantsville, all of Conn.

[73] Assignee: Sun Hill Industries, Inc., Stamford, Conn.

[ * ] Notice: The term of this patent shall not extend beyond the expiration date of Pat. No. 5,195,638.

[21] Appl. No.: 635,059

[22] Filed: Apr. 19, 1996

Related U.S. Application Data

[63] Continuation of Ser. No. 261,848, Jun. 17, 1994, abandoned, which is a continuation-in-part of Ser. No. 891,398, May 29, 1992, Pat. No. 5,458,932, and Ser. No. 554,967, Jul. 18, 1990, abandoned, which is a continuation of Ser. No. 384,728, Jul. 25, 1989, abandoned.

[51] Int. Cl.[6] ..... B44C 3/06

[52] U.S. Cl. ..... 428/16; 206/457; 206/575; 428/35.2; 428/542.2; 446/73; 446/268

[58] Field of Search ..... 428/8, 11, 16, 428/35.2, 542.2; 434/82; 446/268; 206/457, 575

[56] References Cited

U.S. PATENT DOCUMENTS

| | | | |
|---|---|---|---|
| 177,749 | 5/1876 | Redden | 383/36 |
| D. 310,023 | 8/1990 | Dembiczak et al. | 428/35.2 X |
| D. 317,254 | 6/1991 | Dembiczak et al. | 428/35.2 |
| 492,071 | 2/1893 | Vaughan | 383/71 |
| 514,159 | 2/1894 | Nelson | 206/457 |
| 824,071 | 6/1906 | Faber et al. | 446/220 |
| 1,237,930 | 8/1917 | Malvern et al. | 383/6 |
| 1,287,154 | 12/1918 | Wells | 446/372 |
| 1,308,432 | 7/1919 | Lochridge | 446/369 |
| 1,536,816 | 5/1925 | Sale | 446/27 |
| 1,649,770 | 11/1927 | Miller | 446/220 |
| 1,698,653 | 1/1929 | Poole | 446/72 |
| 1,703,901 | 3/1929 | Schultz | 428/11 X |
| 1,950,539 | 3/1934 | Brownfield | 383/70 |
| 1,965,040 | 7/1934 | Kelly | 383/40 X |
| 2,008,552 | 7/1935 | Jacobs | 446/221 |
| 2,009,511 | 7/1935 | Nydegger | 383/70 X |
| 2,112,477 | 3/1938 | Brownfield | 383/71 |

(List continued on next page.)

FOREIGN PATENT DOCUMENTS

| | | | |
|---|---|---|---|
| 39851 | 5/1907 | Switzerland . | |
| 379876 | 9/1932 | United Kingdom | 446/220 |

OTHER PUBLICATIONS

"Hanging Pumpkins" Flyer from Sun Hill Industries, Inc. Oct. 1992.

Dennison's Party Magazine, Oct. 11, 1927 pp. 19, 21,37.

Holiday, A Handbook for Teachers of Elementary Art Educational Service, Inc., pp. 24–25.

Creative Ideas for Christman, 1985 Oxmoor House, Inc. pp. 58 & 59.

Holiday Gifts, Favors and Decorations, Lothrop, Lee & Shepard Co. 1971 pp. 77–79, 82, 83 & 91.

*Primary Examiner*—Henry F. Epstein

*Attorney, Agent, or Firm*—David P. Gordon

[57] ABSTRACT

A decorative Christmas tree ornament assembly includes a plastic sleeve with an open top end and an opposed bottom end, at least one closure apparatus, and a hanging apparatus. Where the bottom end of the plastic sleeve is open, it is bunched closed with a closure apparatus such as a twist-tie. A filling material, such as presents and/or crumpled newspaper, batting, tissue paper or leaves, is inserted into the sleeve through the open top end until the sleeve takes on a substantially rounded shape. The top end is bunched closed with another closure apparatus in a fashion similar to the bottom end. The assembled ornament is hung with the hanging apparatus from a tree, such as an evergreen Christmas tree. The top end closure apparatus and the hanging apparatus can be a single long twist-tie, typically eighteen inches long. Methods of forming the outdoor Christmas tree ornament are also described.

15 Claims, 5 Drawing Sheets

U.S. PATENT DOCUMENTS

| | | | |
|---|---|---|---|
| 2,460,963 | 2/1949 | Young | 383/71 X |
| 2,682,903 | 7/1954 | Gay | 383/71 |
| 3,163,418 | 12/1964 | Myers | 428/16 X |
| 3,195,265 | 7/1965 | Marquez et al. | 428/16 X |
| 3,308,936 | 3/1967 | Roland et al. | 383/71 X |
| 3,349,991 | 10/1967 | Kessler | 383/120 |
| 3,442,043 | 5/1969 | Panzer | 446/109 |
| 3,626,634 | 12/1971 | Jones et al. | 446/122 |
| 3,650,298 | 3/1972 | Delmar | 383/71 X |
| 3,670,440 | 6/1972 | Yost | 428/16 X |
| 4,197,983 | 4/1980 | Raudys et al. | 383/24 |
| 4,436,204 | 3/1984 | Sowinski | 206/527 X |
| 4,445,230 | 4/1984 | Spadaro | 383/7 |
| 4,746,226 | 5/1988 | Von Schuckmann | 383/71 |
| 4,795,033 | 1/1989 | Duffy | 428/21 X |
| 5,195,638 | 3/1993 | Zinbarg | 428/16 X |
| 5,211,996 | 5/1993 | Zinbarg | 446/268 X |
| 5,285,898 | 2/1994 | Zinbarg et al. | 446/73 X |
| 5,358,763 | 10/1994 | Zinbarg | 428/16 |
| 5,458,932 | 10/1995 | Zinbarg et al. | 428/16 |

FIG. 11
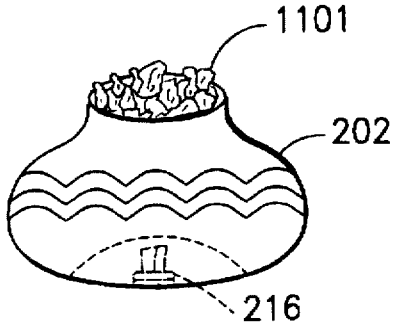
FIG. 11a
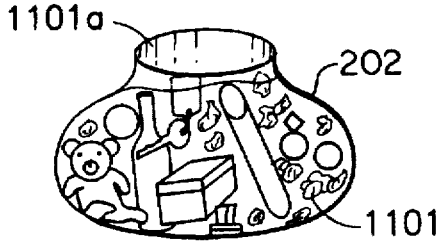
FIG. 12
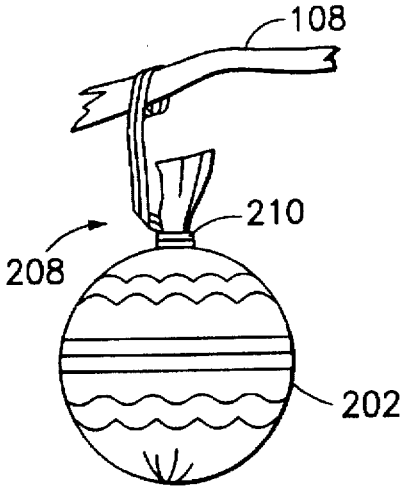
FIG. 13
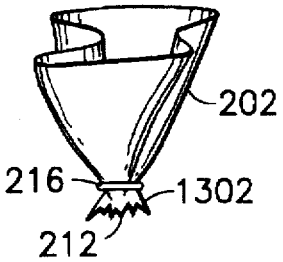
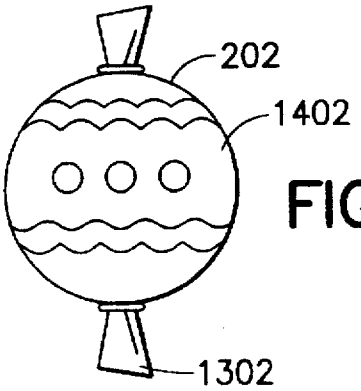
FIG. 14

CHRISTMAN TREE ORNAMENT ASSEMBLIES

This application is a continuation of now abandoned Ser. No. 08/261,848, filed Jun. 17, 1994, which is a continuation-in-part of Ser. No. 07/891,398 filed May 29, 1992, now U.S. Pat. No. 5,458,932, and of Ser. No. 07/554,967 filed Jul. 18, 1990, now abandoned, which is a continuation of Ser. No. 07/384,728 filed Jul. 25, 1989, now abandoned, the complete disclosures of which are hereby incorporated by reference herein.

BACKGROUND OF THE INVENTION

1. Field of the Invention

This invention relates to tree ornaments and ornament assemblies. More particularly, the invention relates to a specially made combination of otherwise common materials, which when properly arranged simulates or represents a Christmas tree ball ornament.

2. State of the Art

At certain times of the year, such as during the Christmas season, it is not uncommon to see Christmas trees in homes garnished with various decorations including spherical and brightly colored ornaments. As these ornaments are often relatively costly to manufacture and bear some sentimental value for the owner, they are frequently placed in storage for reuse during subsequent Christmas seasons. Storage, however, is difficult due to the fact that such ornaments are usually fabricated from fragile materials and thus require careful handling and the use of often bulky protective wrapping.

Although it is known in the art to decorate outdoor Christmas trees with ornaments other than lights, such a practice is relatively uncommon practice because of the expense, difficulty of assembly and fragility of ornaments which are sufficiently large and bright to fulfill the same role as the indoor type ornaments.

While large decorative tree ornaments are not common, in another continuation-in-part (issued as U.S. Pat. No. 5,195,638 to Zinbarg) to one the parents of the present application, a Christmas theme decoration made of inexpensive, weather proof, and disposable materials was disclosed. This outdoor Christmas theme decoration took the form of stuffed rounded plastic bags or flexible sheets with a supporting stuffed bag member bearing various Christmas designs and/or themes, such as Santa Claus, Christmas trees, Christmas gifts, and elves. U.S. Pat. No. 5,195,638, however, is directed to the use of stuffable plastic or flexible bags which sit on the ground. No suggestion is made therein to make Christmas tree ornaments which can be hung from outdoor tree branches.

SUMMARY OF THE INVENTION

It is therefore an object of the present invention to provide a stuffable plastic bag which can include various designs and colors, and which when assembled as part of an assembly represents an outdoor Christmas tree ornament.

A further object of the present invention is to provide a simple, inexpensive, easy-to-manufacture, easy-to-assemble Christmas tree ornament.

Another object of the invention is to provide a Christmas tree ornament which is durable, lightweight and easy to store.

Still another object of the invention is to provide a Christmas tree ornament which is weatherproof and disposable.

In accordance with the objects of the present invention, a decorative bag assembly is provided which includes a plastic sleeve with a top end and an opposed bottom end, first and second closing means, and a hanging means. The bottom end of the plastic sleeve is bunched closed with the first closure means. A filling material, such as crumpled newspaper, cotton or polyester batting, tissue paper, or leaves, is inserted into the sleeve through the open top end until the sleeve takes on a substantially rounded shape. The top end is bunched closed with the second closure means in a fashion similar to the bottom end to form the ornament. The assembled ornament is hung with the hanging means from a tree branch, preferably a type of tree most commonly associated with Christmas trees such as an evergreen.

According to the method of the invention the plastic sleeve of the apparatus invention is provided with an open top end opposite an open bottom end. One closure means is used to bunch together and close the inverted bottom end so that the resulting closed bottom end faces into the bag without any external protrusions. In this manner, an improved rounded shape is obtained when the filling material is inserted and the top end is closed.

According to other aspects of the invention, instead of requiring two closing means, the sleeve may be manufactured with one closed end such that only one closing means is utilized.

Also, instead of using a separate closing means and a separate hanging means, a single device could be used to accomplish both functions. Further, in an alternative embodiment of the invention, instead of filling the sleeve entirely with crumpled newspapers, batting, tissue paper, etc., the bag may be filled with small and light Christmas gifts which are surrounded with newspaper or other filling material.

Additional objects and advantages of the invention will become apparent to those skilled in the art upon reference to the detailed description in conjunction with the accompanying drawings.

BRIEF DESCRIPTION OF THE DRAWINGS

FIGS. 7–12 illustrate steps in the preferred method of assembling the ornament assembly of the invention.

FIGS. 13 and 14 show an alternative method of assembling the ornament assembly of the invention.

DETAILED DESCRIPTION OF INVENTION

Figure 1:
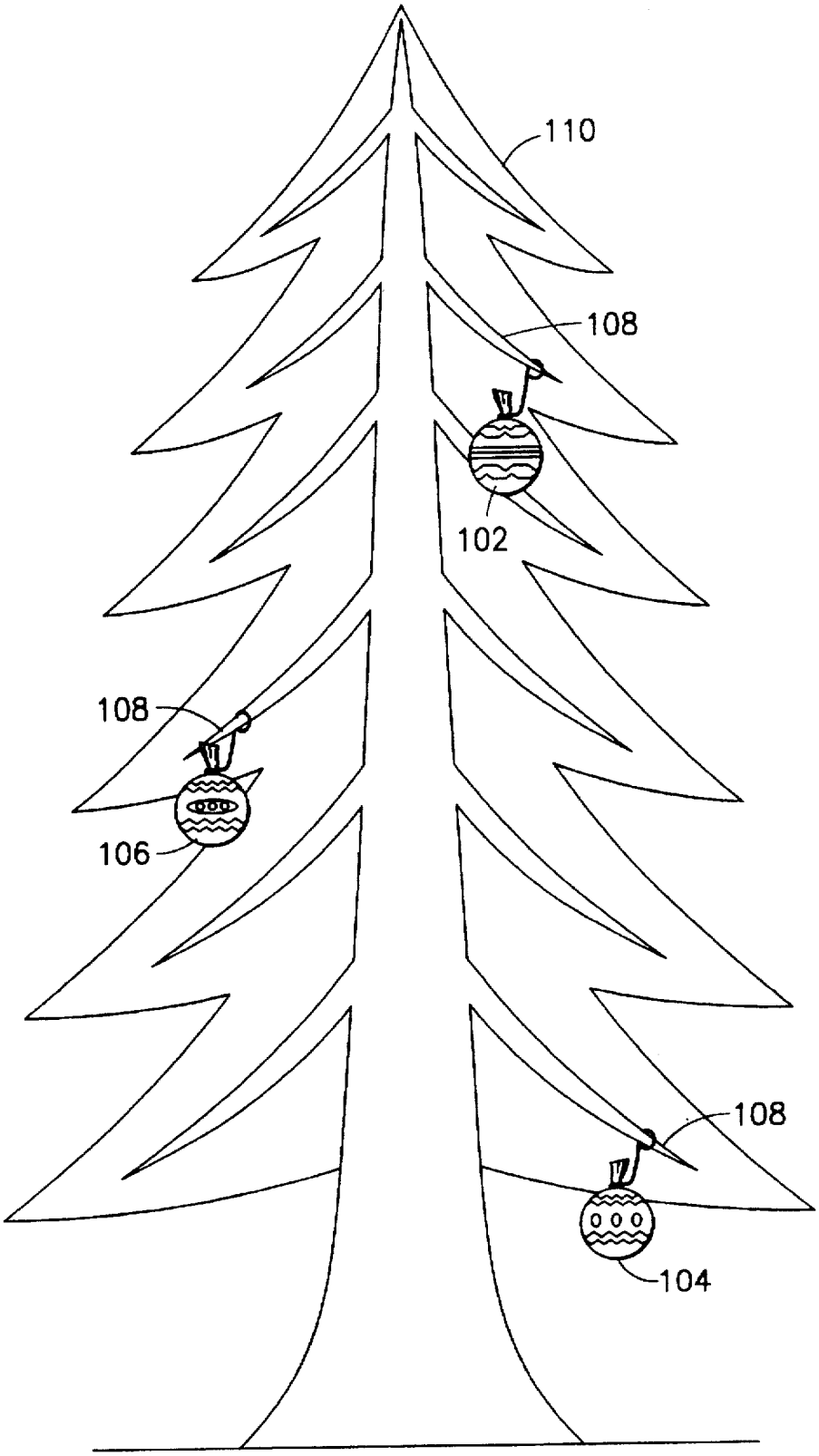
FIG. 1 is a perspective diagrammatic view of a tree with the ornaments of the invention hanging from various branches of the tree.
Figure 2:
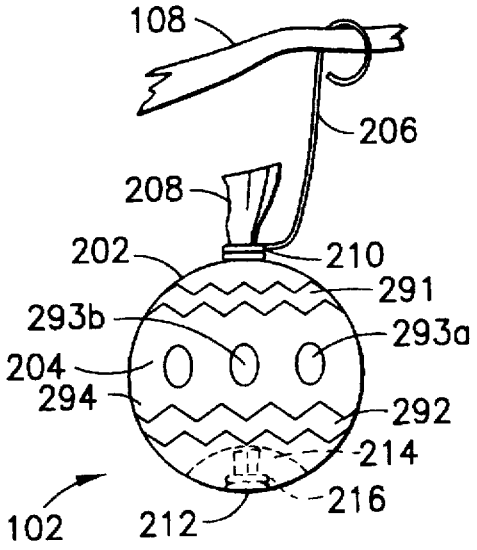
FIG. 2 is a detailed view of a Christmas tree ornament assembly of the invention.

Turning to FIG. 1, several Christmas tree ornament assemblies 102, 104, 106 according to the invention are depicted hanging from the branches 108 of an outdoor evergreen tree 110. As seen in the detailed view of FIG. 2, the Christmas tree ornament 102 generally includes a flexible plastic sleeve 202, a Christmas related thematic design 204 imprinted on the exterior of the sleeve 202, first and second closure means 210 and 216 for respectively closing the top end 208 and bottom end 212 of the sleeve 202, and a hanging means 206 for hanging the stuffed, closed sleeve 202 to a branch 108 of the tree. A filling material, such as crumpled newspaper, batting, tissue paper, or leaves is inserted into the plastic bag 202 before the top end 208 is closed in order to give it a rounded shape of a ball as seen in FIG. 2.

In the preferred embodiment, the bottom end 212 of sleeve 202 is inverted according to the method of the invention (discussed hereinafter with reference to FIGS. 7–12) and closed with one closure means 216 shown here to be a twist-tie. After the filling material is inserted in sleeve 202, the top end 208 of sleeve 202 is bunched closed with another closure means 210, also preferably a twist-tie. The twist-tie 210 is preferably a long twist-tie which doubles as the hanging means. Regardless, when stuffed, the sleeve 202 assumes a rounded or substantially spherical ball shape with a preferred diameter of eight inches.

According to the preferred embodiment of the invention, the plastic sleeve 202 is provided with a design 204 such as a symmetrical design with bright colors (e.g., red, green, blue and yellow) characteristic of the Christmas season. In the particular embodiment shown in FIG. 2, the design consists of two substantially parallel serrated white lines 291, 292 with a row of evenly spaced white dots 293*a*, 293*b*, . . . therebetween on a red background 294. The indicia and colors, however, may appear in a multitude of forms and combinations.

Figure 3A:
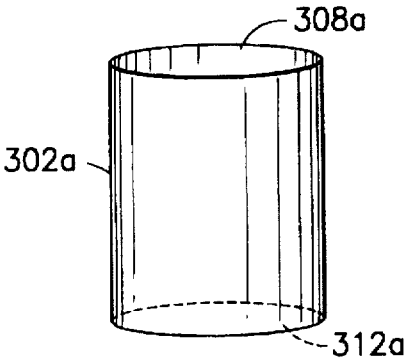
FIGS. 3*a*–3*f* show six different embodiments of the plastic sleeve used in the ornament assembly of the invention.

FIG. 3*a* shows the presently preferred flexible sleeve used in forming a Christmas tree ball ornament. The sleeve 302*a* is made of flexible, stretchable plastic material and is formed in a substantially cylindrical shape, with an open top end 308*a* opposite an open bottom end 312*a*. In a typical embodiment to simulate Christmas ornaments, it is preferred that the sleeve be made of polyethylene, polypropylene, PVC, or similar material having a thickness in the preferred range of about 0.50 to 2.0 mils with a preferred thickness of about 1.3 mils. It is also preferred that the sleeve have a height in the range of nine to eighteen inches with a preferred height of fourteen inches, and a width in the range of seven to sixteen inches with a preferred width of eleven inches, which provides an ornament having a diameter in the range of five to twelve inches with a preferred diameter of eight inches when the sleeve is closed and filled with sufficient filling material so as to be rounded.

Figure 3B:
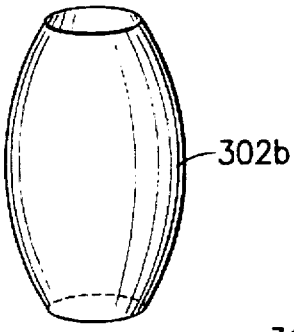
Figure 3C:
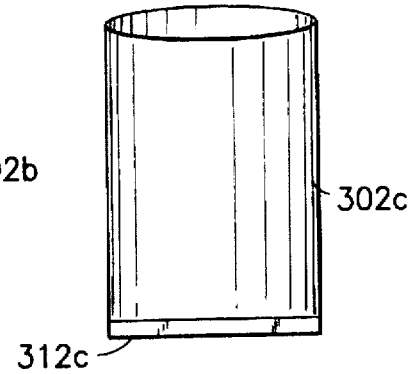
Figure 3D:
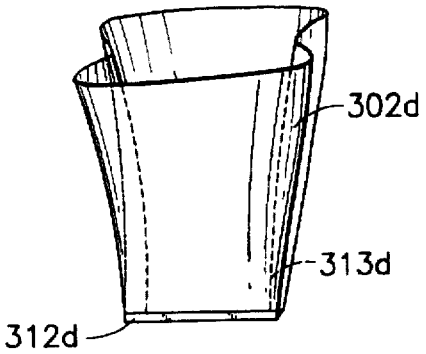
Figure 3E:
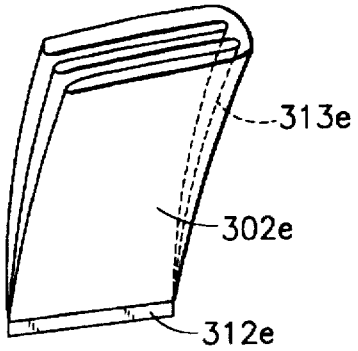
Figure 3F:
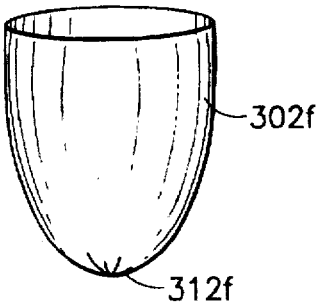

The sleeve may have any other suitable configuration within the scope of the present invention. For example, a sleeve 302*b* having a convex cylindrical configuration is shown in FIG. 3*b*. Also, if the sleeve is pre-closed on one end, it takes the form of a bag. Thus, a conventionally shaped plastic bag 302*c* having a linearly closed bottom end 312*c* is seen in FIG. 3*c*. As yet other alternatives, the sleeve may take the form of a conventional gussetted bag 302*d* as in FIG. 3*d*, or a Z-lock configuration gusseted bag 302*e* shown in FIG. 3*e*, where the opposed sides of the bag are each drawn inwardly into the bag and secured to the overlapping bottom 312*d*, 312*e* portion to form gussets 313*d* and 313*e*. A bag 302*f* having a star sealed closed bottom end 312*f* is seen in FIG. 3*f*.

Figure 4:
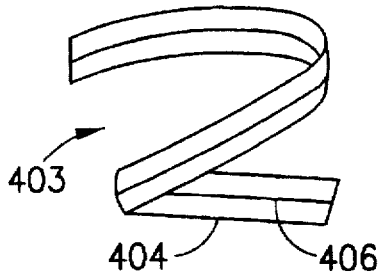
FIG. 4 is a perspective view of a twist tie closure means.

FIG. 4 shows a perspective view of the preferred closure means of the invention, which is a well-known twist tie 402 of about five inches in length. The twist tie 403, has a flexible plastic or paperlike wide portion 404 and a wire member 406 embedded therein or connected thereto. The wire member 406 permits tying and twisting of the twist-tie 403 around the bunched top end 208 or bottom end 212 of the plastic bag 202 (see FIG. 2). Alternative closure means to the twist tie are available, such as a clamp, a rubber band, string, or the like which can be used in place of the twist-tie.

Figure 5:
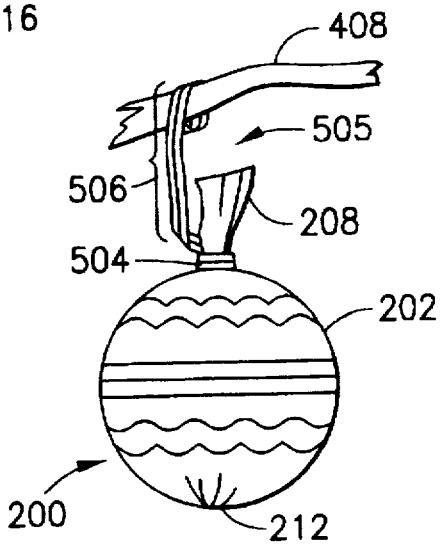
FIG. 5 shows the ornament assembly of the invention with preferred embodiment of the hanging means.

Turning to FIG. 5, the preferred hanging means 505 of the invention is shown. The preferred hanging means 505 is an elongated twist-tie such as described in FIG. 4, but having a length typically ranging from ten to twenty-four inches, with a preferred length of eighteen inches. A first end 504 of the hanging means 505 acts as the twist tie closure means shown in FIG. 4, and is tied or twisted around the top end 208 or bottom end 212 of the stuffed plastic sleeve 202. A second end 506 of the hanging means 505 is securely tied or twisted around the branch of a tree 108.

Figure 6:
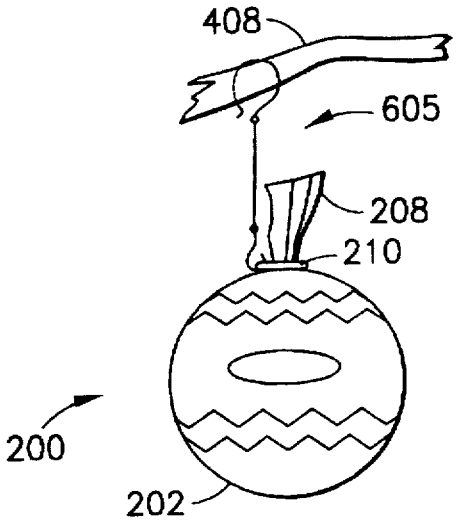
FIG. 6 shows the ornament assembly of the invention with an alternative embodiment of the hanging means.

Another embodiment of the hanging means is seen in FIG. 6. FIG. 6 shows a flexible wire 605 with a first hooked end 604 and a second hooked end 606. The first hooked end 604 attaches to the closure means 210 used for closing the top end 208 of the bag 202. The second hooked end 606 attaches to the tree branch 108 such that the filled plastic sleeve 202 hangs securely from the tree branch 108.

Figure 7:
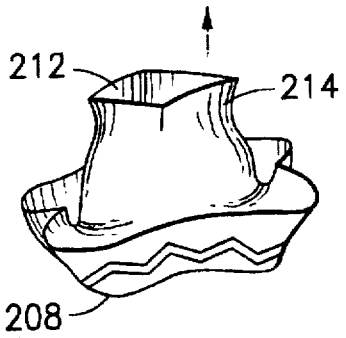
Figure 8:
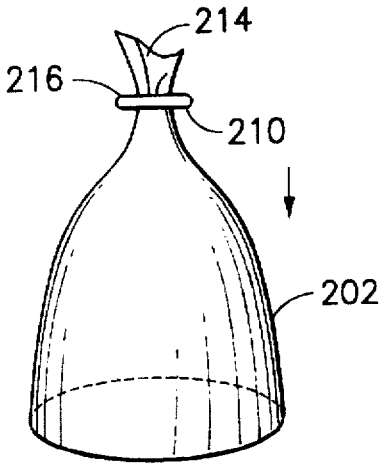
Figure 9:
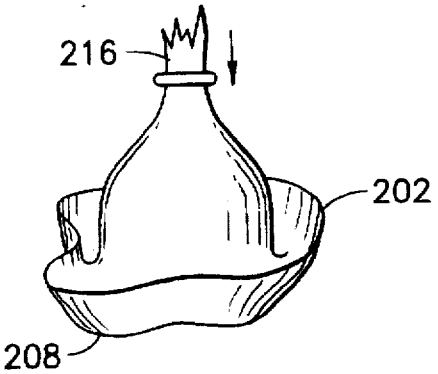
Figure 10:
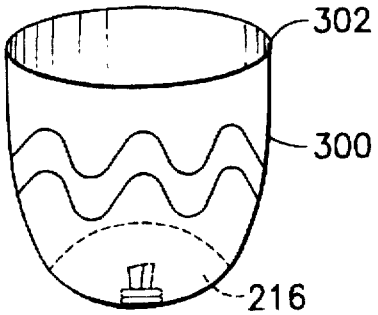

FIGS. 7–12 show the preferred method for assembly of the ornament of the invention where the sleeve 202 is of a type having opposite open ends as illustrated in FIGS. 3*a* and 3*b*. As shown in FIG. 7, the bottom end 212 of the sleeve 202 is passed through the open top end 208 so that at least the bottom end 212 is inside out, forming an inverted bottom end 214. It will be appreciated that this first step is unnecessary where the sleeve is already turned inside out and the bottom end is thus already inverted. As seen in FIG. 8, the inverted bottom end 214 is then closed with a first closure means 210 to form a closed inverted bottom end 216. As shown in FIG. 9, the closed inverted bottom end 216 is then passed through the open end 208 of the sleeve 202 such that when the sleeve 202 is fully turned outside in, as shown in FIG. 10, the inverted bottom closed end 216 does not protrude outside the sleeve 202. Referring to FIG. 11, the sleeve 202 with the inverted closed bottom end is thereafter filled with crumpled newspaper, tissue paper, batting, leaves, or the like, 1101 such that it assumes a substantially rounded, generally spherical shape.

FIG. 11*a* illustrates an alternate embodiment of the method invention, where the sleeve 202 is filled with fittably sized Christmas gifts 1101*a* and then further stuffed with filling material 1101. As seen in FIG. 12, the top end 208 of the sleeve 202 is then bunched closed with a closure means 210. As a result, the rounded configuration shown in FIG. 12 is achieved. The closed rounded ornament 202 is then hung on a branch 108 of an outdoor (or indoor) tree 220 by use of a hanging means 204. Where the stuffed sleeve 202 has been filled with Christmas gifts 1102*a* (FIG. 11*a*), it can subsequently be reopened to reveal the hidden gifts by simply detaching it from the tree branch 220, and untying the top end closure means 210 (FIG. 12).

Another method of assembling the bottom end of the sleeve is illustrated in FIG. 13. FIG. 13 shows bottom end 212 being bunched closed with a closure means 216 so as to form a bottom end 1302 which protrudes outside the sleeve 202. FIG. 14 shows an ornament 200 assembled according to this method of the invention, with the bottom closed end 1302 protruding outside the sleeve 202.

There have been described and illustrated herein several embodiments and methods of assembling a Christmas tree ornament assembly. While particular embodiments of the invention have been described, it is not intended that the invention be limited thereto, as it is intended that the invention be as broad in scope as the art will allow and that the specification be read likewise. Thus, while particular preferred embodiments of the present invention have been described and illustrated, it is apparent that the sleeve or bag material can be of any other type of plastic film-type or substantially weatherproof material. It will also be appreciated that while specific ranges for the dimensions of the plastic sleeve have been given, and large sleeves give the desired effect for outdoor trees, other suitably dimensioned plastic sleeves or bags can be used. Furthermore, while particular stuffing materials have been disclosed, any suitable stuffing material can be used. In addition, while the sleeves and bags of the invention were described as having preprinted brightly colored indicia, it will be appreciated, though while not preferred, that the indicia could be added later. It will therefore be appreciated by those skilled in the art that yet other modifications could be made to the provided invention without deviating from its spirit and scope as so claimed.

What is claimed is:

1. An assembly which forms a Christmas tree ball ornament upon stuffing with filling material, comprising:

a) a weatherproof sleeve made of flexible material having a top end and a bottom end opposite each other, at least said top end being open for receiving filling material therein;

b) a first closure means for bunching together and closing said top end of said flexible sleeve to form a bunched closed top end, wherein said flexible sleeve has a substantially rounded shape when filled with the filling material and said top end is bunched by said bunching means and thereby forms a Christmas tree ball ornament having a bunched closed top end; and c) hanging means for hanging said Christmas tree ball ornament by said bunched closed top end to a branch of a tree.

2. An assembly according to claim 1, wherein:

said first closure means is a strip of material made from one of plastic and paper, and having a wire embedded in said material.

3. An assembly according to claim 1, wherein:

said bottom end of said flexible bag is formed in a gusseted Z-lock configuration.

4. An assembly according to claim 1, further comprising:

a second closure means, wherein said bottom end of said plastic bag is open and is bunched closed by said second closure means.

5. An assembly according to claim 1, wherein:

said flexible material is a brightly colored polyethylene.

6. An assembly according to claim 1, wherein:

said sleeve has a thickness in the range of between 0.50 to 2.0 mils, and a height in the range of between nine and eighteen inches, and a width in the range of between seven and sixteen inches, and when said sleeve is filled with the filling material and said top and said bottom ends are closed, a substantially spherical ball is formed with a diameter in the range of between five and twelve inches.

7. An assembly according to claim 6, further comprising:

a second closure means, wherein said bottom end of said sleeve is open and is bunched closed by said second closure means, and said flexible material is polyethylene.

8. An assembly according to claim 1, wherein:

said first closure means and said hanging means together constitute an elongated twist-tie having a length of at least ten inches.

9. An assembly according to claim 8, further comprising:

a second closure means, wherein said bottom end of said plastic sleeve is open and is bunched closed by said second closure means, and said flexible material is polyethylene.

10. An assembly which forms a Christmas tree ball ornament after stuffing with filling material, comprising:

a) a plastic weatherproof flexible bag having a top end and a bottom end opposite each other, at least said top end being open for receiving the filling material therein; and b) a first bunching means having a first end and a second end, said first end for bunching together and closing said top end of said flexible bag to form therein a bunched closed top end after filling material is inserted in said bag, and a second end for hanging said bag to a branch of an outdoor tree, wherein, said flexible bag has a substantially rounded shape when filled with the filling material and said top end is bunched by said first end of said first bunching means and forms a Christmas tree ball ornament.

11. An assembly according to claim 10, wherein:

said first bunching means is a strip of material made from one of plastic and paper, and having a wire embedded in said material.

12. An assembly according to claim 11, wherein:

said first bunching means is at least ten inches long.

13. An assembly according to claim 10, wherein:

said bottom end of said plastic bag is open and is bunched closed by use of a second closure means.

14. An assembly according to claim 10, wherein:

said flexible material is polyethylene.

15. An assembly according to claim 10, wherein:

said bag has a thickness in the range of between 0.50 to 2.0 mils, and a height in the range of between nine and eighteen inches, and a width in the range of between seven and sixteen inches, and when said bag is filled with the filling material and said top and said bottom ends are closed, a substantially spherical ball is formed with a diameter in the range of between five and twelve inches.

* * * * *